United States Patent [19]

Day, V et al.

[11] Patent Number: 4,790,334

[45] Date of Patent: Dec. 13, 1988

[54] PORTABLE CURING FRAME

[75] Inventors: George B. Day, V; Larry G. Wells; Timothy D. Smith; Ira J. Ross, all of Lexington, Ky.

[73] Assignee: The University of Kentucky Research Foundation, Lexington, Ky.

[21] Appl. No.: 9,949

[22] Filed: Feb. 2, 1987

[51] Int. Cl.[4] ..... A24B 1/08

[52] U.S. Cl. ..... 131/290; 34/240; 56/27.5; 294/5.5; 296/5

[58] Field of Search ..... 131/290; 56/27.5; 294/5.5; 296/5; 34/240

[56] References Cited

U.S. PATENT DOCUMENTS

| | | | |
|---|---|---|---|
| 322,330 | 7/1885 | Snow | 294/5.5 |
| 2,785,919 | 3/1957 | Grondzik | 294/5.5 |
| 4,367,621 | 1/1983 | Swetnam et al. . | |

OTHER PUBLICATIONS

Casada et al., Harvesting, Handling and Curing Notched Burley Plants on Wires, Jan.–Feb., 1986.

*Primary Examiner*—V. Millin

*Attorney, Agent, or Firm*—King & Schickli

[57] ABSTRACT

A portable curing frame is provided particularly adapted for use with an automated tobacco harvester. The curing frame includes a substantially rectangular frame member including a series of slotted tracks, in the form of slotted tubes, specially designed for receiving a notched portion of the plant stalks. The slotted track is substantially continuous and thereby allows infinitely variable spacing between the plants and optimization of ventilation for air curing. Legs are also provided on the portable curing frame. The legs are displaceable between a retracted position allowing storage of the frames and loading of the frames with tobacco plants and an extended position for supporting the frames and inverted plants above the ground in the field. A locking mechanism is provided to positively retain the legs in both the retracted and extended positions. A triggering mechanism is also provided to release the locking mechanism and allow the legs to be displaced by gravity from the retracted position to the extended position. The tobacco-laden curing frame may be covered by plastic or other material and left in the field to cure. Once curing is completed the cured plants may be mechanically removed from the frames for optimum speed in handling the plants and bringing the tobacco to market.

13 Claims, 2 Drawing Sheets

FIG. 1
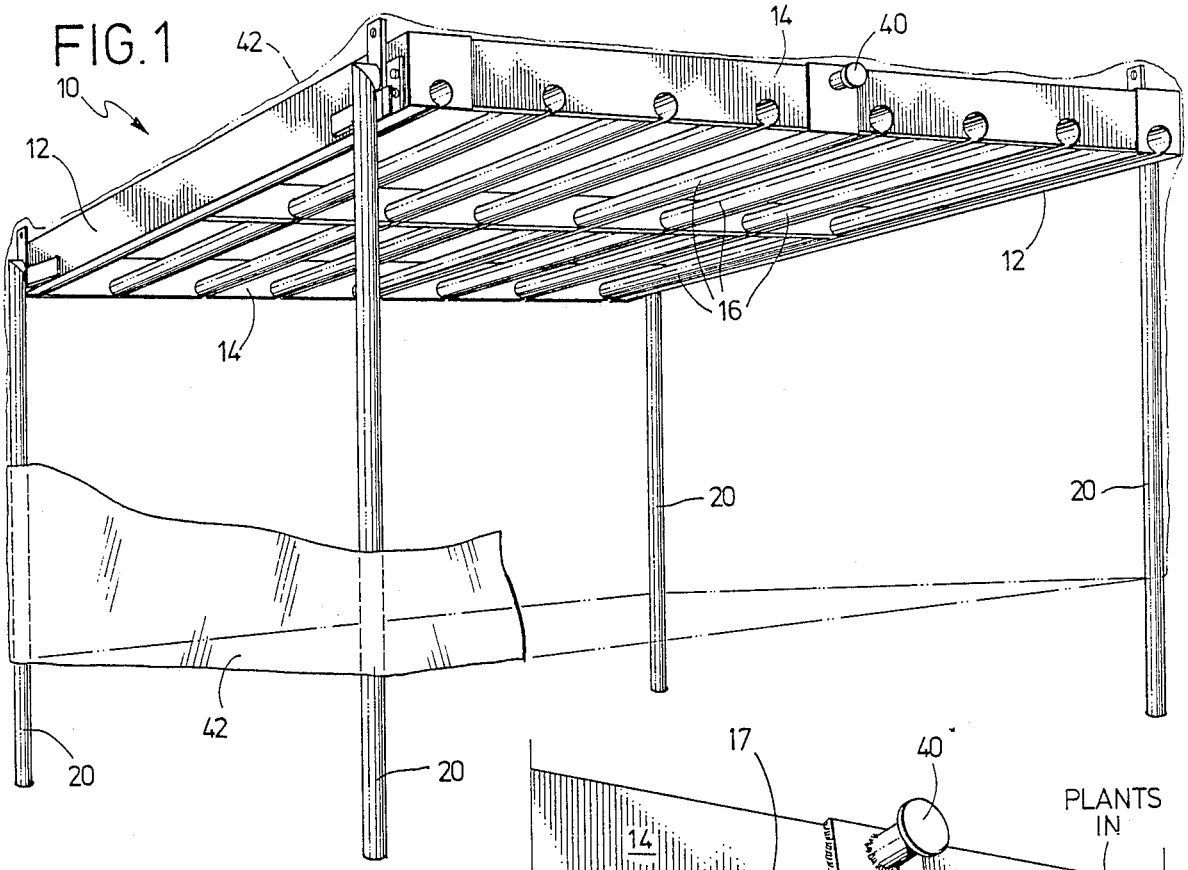
FIG. 2
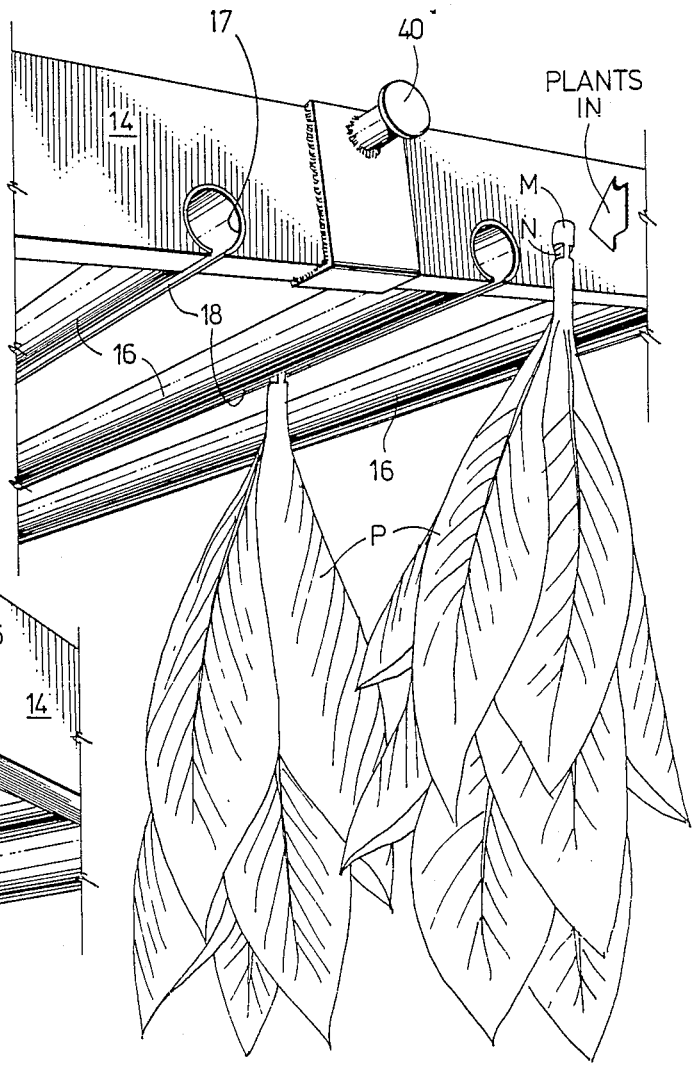
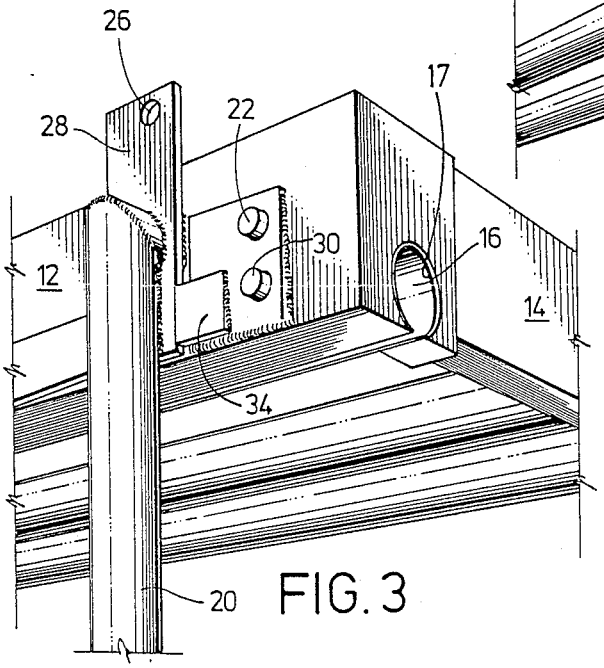
FIG. 3

12
20
28
7
22
38
34
30
36
B
26
24
18
16
32
A
C
D

PORTABLE CURING FRAME

TECHNICAL FIELD

The present invention relates generally to the tobacco harvesting field and, more particularly, to a portable curing frame specifically adapted for use with an automated tobacco harvester.

BACKGROUND OF THE INVENTION

Burley tobacco harvesting remains to this day an essentially manual operation. Tobacco is harvested by first detaching or cutting plants near the ground. Five or six plants are then impaled upon a wooden member or stick having dimensions of substantially 1×1×54 inches. Tobacco-laden sticks are left in the field for several days until such time as the tobacco plants wilt. The sticks are then collected and transported to a curing barn. The sticks are placed or stored at spaced intervals on parallel rails in the curing barn. The inverted plants hang down from the sticks between the rails with the necessary spacing between the plants for on-the-plant curing of the leaves by natural ventilation.

As with any labor intensive procedure, the harvesting of tobacco in the manner described above is a relatively slow procedure. Further, with limited skilled labor available, the process is also relatively expensive. Despite a clear need and desire for a less expensive and faster harvesting procedure, up to this point in time no commercially successful fully automated method of harvesting tobacco has been developed. The primary reason for this failure appears to be related to the fact that burley tobacco plants are highly susceptible to leaf damage and loss. This problem is the result of leaf turgidity, plant size and orientation of the leaves on the plant. These factors clearly limit the extent to which any mechanical component can engage a burley plant and still provide effective harvesting.

An automated tobacco harvester recently developed by the present inventors is fully disclosed in co-pending U.S. patent application Ser. No. 010,176, entitled Apparatus and Method for Automated Tobacco Harvesting and filed on Feb. 2, 1987. This harvester is designed so as to carefully handle and manipulate the burley plants and thus reduce leaf losses during cutting and storing to a level previously only achievable by the most skilled manual laborers.

The harvester is fully mechanized. It includes a system for cutting the plants adjacent the ground. The plants are then conveyed upwardly and inverted through 180 degrees so that the leaves of the plants fall naturally along the stalks. In this way subsequent handling of the plants may be performed without causing any substantial damage to the plants and also the leaves. The stalks of the plants are then cut and notched for receipt at spaced intervals within a portable curing frame of the type described in this document.

SUMMARY OF THE INVENTION

Accordingly, it is a primary object of the present invention to provide an improved portable curing frame furnishing a more efficient and effective way of curing burley tobacco and similar plants.

Another object of the invention is to provide a portable curing frame specially adapted for use with an automated harvester.

A further object of the invention is to provide a portable frame for curing burley tobacco and similar plants that allows adjustable spacing between the burley tobacco plants for optimization of air curing. conditions.

Yet another object of the present invention is to provide a portable curing frame that may be mechanically emptied of plants following curing.

Still another object of the invention is to provide a portable curing frame for receiving and holding plants at spaced intervals that may also be covered with plastic or other material so as to allow field curing and eliminate the need for tobacco curing barns.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for receiving and holding burley tobacco plants or similar plants for curing. The portable curing frame includes a frame member having a substantially rectangular configuration. At least one slotted track extends across the frame member. This track is designed to receive a notched portion of the plant stalks and retain those plants throughout the curing process.

Preferably, a series of slotted tracks are provided extending across the frame member. The tracks are positioned so as to be substantially parallel and equally spaced along the frame member.

More specifically, each slotted track is formed from a slotted tube with the longitudinal opening extending in a downward direction. Advantageously, the wall of the tube covers and protects the end of the stalk adjacent the notch thereby preventing inadvertent damage to the end of the stalk and one means of possible loss of the plant from the curing frame.

In accordance with yet another aspect of the present invention, support legs are attached to the frame member. Preferably, the legs are pivotally connected and are thereby displaceable between a retracted position allowing convenient storage of the frames and loading of the frames with tobacco plants wherein the legs extend along the side walls of the frame member and an extended position wherein the legs extend substantially perpendicular to the walls of the frame member and support the frame member and associated plants above the ground. Thus, the inverted tobacco plants in the slotted tube are effectively held in position for on-the-plant air curing in the field.

The frame member further includes a mechanism, in the form of a spring loaded locking pin, for positively locking the pivotal legs in the retracted and extended positions. A trigger means, such as an actuating pin, is also provided for releasing the locking means and allowing the legs to be displaced from the retracted position to the extended position. The trigger is positioned so as to be automatically actuated as the portable curing frame is moved into an unloading position by the automated tobacco harvester discussed above.

In accordance with still another aspect of this invention, a removable cover may be provided. Following the loading of burley tobacco plants at proper spacing onto the curing frame, the frame may be unloaded from the automatic harvester and placed upright on its support legs in the tobacco field. Plastic or other material is then attached to the frame so as to cover and protect from moisture the tobacco plants contained on the frame. In this way, the apparatus of the present invention allows complete curing of the tobacco in the field thereby eliminating the need to construct or rent a curing barn at great cost savings to the farm operator.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain the principles of the invention. In the drawing:

FIG. 1 is a perspective view of the portable curing frame of the present invention showing the support legs in the extended position;

FIG. 2 is a detailed cut-away view of the portable curing frame of FIG. 1 showing how the tobacco stalks are notched and received within one of the slotted tubes of the curing frame;

FIG. 3 is a detailed cut-away view showing one of the leg locking and triggering mechanisms;

Figures 4, 5, 6, 7, 8, 9:
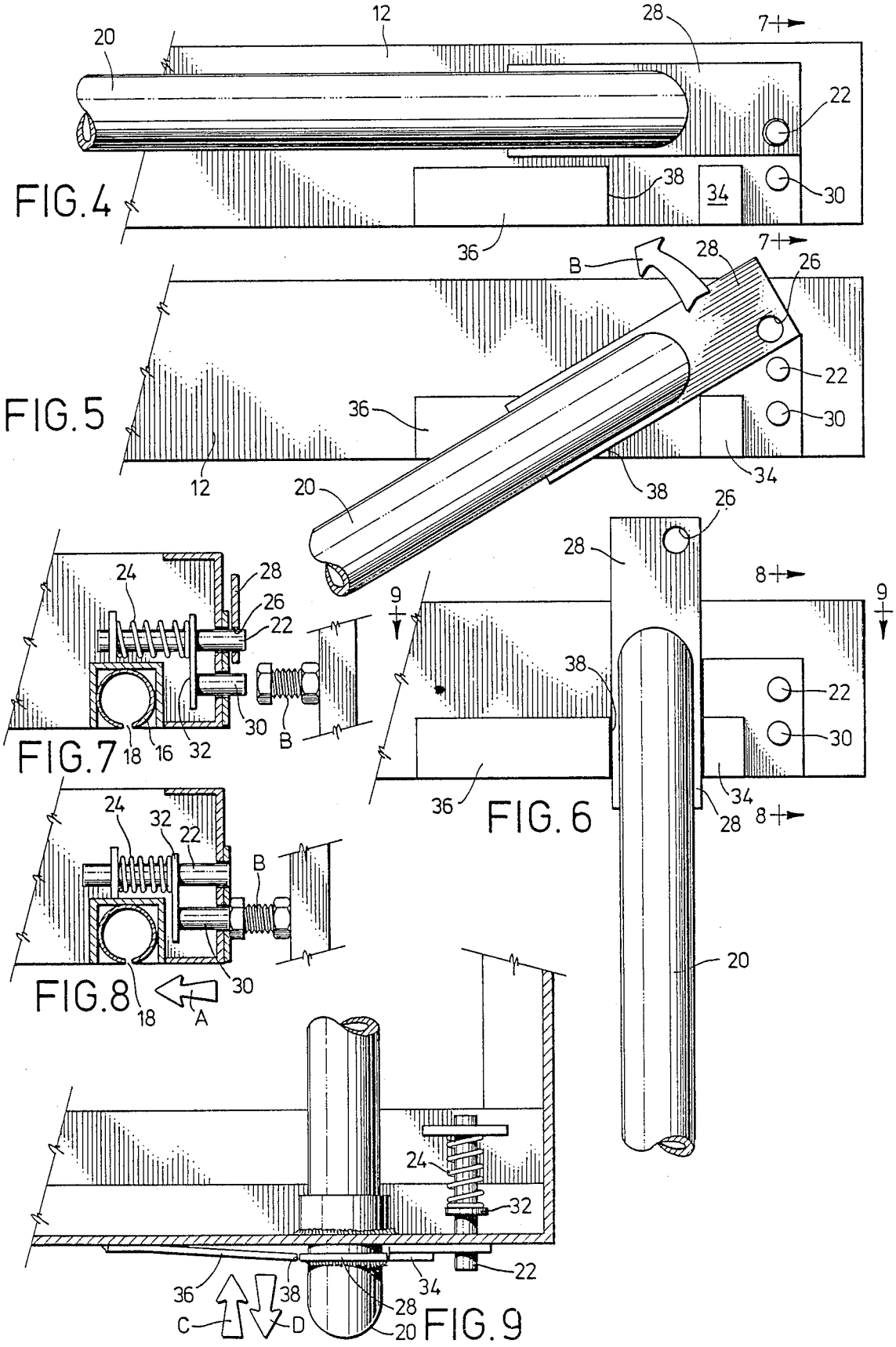
FIG. 4 is a detailed cut-away view showing a leg locked in its retracted, storing and loading position.
FIG. 5 is a cut-away view similar to FIG. 4 showing a leg pivoting toward the extended position following release from the retracted position.
FIG. 6 is a detailed cut-away view showing a leg locked in the extended position.
FIG. 7 is a cross-sectional view of the locking and trigger mechanisms along lines 7—7 of FIG. 4.
FIG. 8 is a cross-sectional view along line 8—8 of FIG. 6 showing actuation of the trigger mechanism.
FIG. 9 is a cross-sectional view along line 9—9 of FIG. 6 showing the positive locking of a leg in the extended position.

Reference will now be made in detail to the present preferred embodiment of the invention, an example of which is illustrated in the accompanying drawing.

DETAILED DESCRIPTION OF THE INVENTION

Reference is now made to FIG. 1 showing an improved portable curing frame 10. As will be appreciated from the description below, while appropriate for utilization in harvesting and curing tobacco plants or the like in any manner including manually, this frame is particularly adapted for utilization with an automated tobacco harvester (not shown) for optimum harvesting efficiency.

As shown, the portable curing frame 10 includes a substantially rectangular frame member having opposing side rails 12 and opposing end rails 14. A series of slotted tracks, preferably in the form of substantially slotted tubes 16, extend between the end rails 14 of the frame member. As best shown in FIG. 2, each slotted tube 16 includes an open end 17 in the end rail 14 specifically adapted for receiving the stalk of a tobacco plant or the like that has been previously notched along each side.

As described in our co-pending application covering the automated tobacco harvester discussed above, the tobacco stalk may be notched by conveying the tobacco plant with the stalk extending between two spaced stacks of saw blades. The length of the stalk above the notch may also be controlled by including an additional saw blade for cutting the tip of the stalk at the desired distance from the notch so as to allow receipt within slot 18 of the tube 16. As should be appreciated, the stalk material in margin M above the notch (as shown in FIG. 2) is wider than the slot 18 in the tubes so as to retain the plant. Additionally, the narrowed portion N of the stalk between the notches allows the plant P to be slidably received in the tube 16. Thus, the spacing of the plants P along the slotted tube 16 is infinitely variable allowing the operator to optimize the spacing for the best air curing The curing frame 10 also includes support legs 20. When extended as shown in FIG. 1, the legs 20 support the curing frame and inverted tobacco plants P (see FIG. 2) in the slotted tubes 16 above the ground for air curing. As best shown from a review of FIGS. 4–9, the legs 20 are pivotally connected to the side rails 12. Thus, the legs 20 are displaceable between a retracted frame loading and storing position with the legs extending along the side rails 12 (see FIG. 4) and an extended position with the legs extending substantially perpendicular to the side rails 12 for supporting the frame member as discussed above (see FIGS. 1 and 6).

A locking mechanism is provided for positively maintaining the legs 20 in both the retracted and extended positions. As shown in FIGS. 4 and 7, the locking mechanism includes a locking pin 22 that is normally biased by a spring 24 so as to extend through an aperture 26 in the leg plate 28. With the pin 22 extended as shown in FIG. 7, the leg 20 is positively prevented from pivoting and thereby retained in the retracted position.

As shown in FIG. 8, the portable curing frame 10 is also provided with a trigger to release the locking pin 22 from the aperture 26 in the leg plate 28. The trigger is in the form of an actuator pin 30 that is positioned substantially parallel to the locking pin 22 and welded thereto by means of the connecting plate 32.

As the portable curing frame 10 is advanced into the unloading position by the automated tobacco harvester, the trigger actuator pin 30 is brought into engagement with an actuating bolt B mounted to the tobacco harvester. As the actuator pin 30 is pushed inwardly in the direction of action arrow A against the force of the spring 24 (see FIG. 8), the locking pin 22 is moved in the same direction and released from the aperture 26 in the leg plate 28. With the release of the locking pin 22, gravity serves to pivot the leg 20 downwardly in the direction of action arrow B (note FIG. 5). The downward pivoting of the leg 20 continues until the leg is substantially perpendicular to the side rail 12 with the edge of leg plate 28 engaging the stop 34 (see FIGS. 6 and 9).

The leg 20 is also positively retained in this extended position by means of the locking spring leaf 36. As the leg pivots downwardly (see FIG. 5), the leaf 36 is held displaced by the leg plate 28 in the direction of action arrow C (see also FIG. 9) as to allow the leg 20 to pivot into the substantially perpendicular position. Once in this position with the leg plate 28 engaging the stop 34, the locking leaf 36 springs back in the direction of action arrow D to its normal position with the leading edge 38 being aligned to engage the trailing edge of the leg plate 28. This action positively maintains the leg 20 in a substantially perpendicular orientation. Of course, the leg 20 may be manually returned to the retracted position by simply pushing the locking leaf 36 in the direction of action arrow C and rotating the leg upwardly in the opposite direction of action arrow B. Next, the actuator pin 30 is pushed in the direction of action arrow A and then the aperture 26 brought into alignment with the locking pin 22. The actuator pin 30 is then released thereby causing the locking pin 22 to extend under the force of the spring 24 through the aperture 26 and engage the leg plate 28 so as to once again positively retain the leg 20 in the retracted position.

As the automated tobacco harvester harvests the tobacco plants it inverts the plants and both tips and notches the plants as shown in FIG. 2. The plants are then fed into the first of the tubes 16 at the left side of the frame. Once this first tube 16 is filled with plants at the desired spacing by means of a conveyor, the portable curing frame 10 is shifted or indexed so as to then allow filling of the next slotted tube 16.

This process continues until each of the slotted tubes 16 is filled with tobacco plants at the desired spacing. When completely filled, the portable curing frame 10 is advanced by the tobacco harvester to the unloading position. The trigger actuator pin 30 is brought into engagement with the bolt B (see FIG. 8) thereby releasing the locking pin 22 and allowing the legs 20 to be displaced into the extended position (shown in FIGS. 1 and 6).

Once the legs 20 are locked in the extended position, the tobacco-laden curing frame 10 is unloaded from the harvester by means of hydraulically controlled lift arms (not shown) that engage the lift pins 40 located along the center line of the curing frame at each end (see FIGS. 1 and 2). Once unloaded, the portable curing frames 10 are supported on the legs 20 standing upright in the field with the inverted tobacco in the slotted tubes 16 being held above the ground with the necessary spacing to provide ventilation for air curing.

Once the plants wilt, a covering 42 (shown broken away and in phantom line in FIG. 1) may be extended over and around the legs 20 of the frame so as to allow complete curing in the field. In this way, the farm operator need never construct and maintain a curing barn or rent space in a curing barn. Thus, the portable curing frames allow the elimination of these large additional costs to tobacco farming operations.

Preferably, the covering 42 comprises plastic that is extended over the frame 10 and around the legs 20 and held in position by tape or appropriate clips. Advantageously, during the covering process, it should be appreciated that the wall of the slotted tube 16 encircling and covering the top of the stalks above the notch prevents any inadvertent damage to the stalks that could lead to the stalks pulling through the slot 18 and falling from the curing frame to the ground. In this way, the portable curing frame further reduces crop losses thus improving overall yield.

In summary, numerous benefits have been described which result from employing the concepts of this invention. Advantageously, the portable curing frame of the present invention includes a substantially continuous slotted track 16 for receiving notched stalks of tobacco plants or the like. Advantageously, this track allows the spacing between the plants to be adjusted so as to provide optimum air curing conditions. The portable curing frame is also specially adapted for use with an automated tobacco harvester so as to allow the most efficient and effective harvesting of the tobacco crop with minimum costs to the farm operator. Further, the portable curing frame may be covered with plastic or other material so as to allow complete field curing and eliminate any need for the construction and maintenance of a curing barn. Ideally, the material of the covering should be impervious to moisture, but having open pores to allow breathing and rapid curing of the plants. Additionally, it should be appreciated that the portable curing frame advantageously allows the mechanical emptying of cured plants from the frames thereby providing a more efficient and effective means of handling the tobacco plants throughout the entire harvesting and curing process.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the portable curing frames may be adapted to allow stacking. In this way, where curing in the barn is preferred, space can be conserved. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A portable curing frame for receiving and holding tobacco plants or the like having stalks, comprising:

a frame member including a substantially continuous and elongated slotted track in the longitudinal direction for receiving in free sliding engagement a portion of the plant stalks.

2. The portable curing frame set forth in claim 1, further comprising a series of slotted tracks connected to said frame member.

3. The portable curing frame set forth in claim 2, wherein said series of slotted tracks are substantially parallel and equally spaced along said frame member.

4. The portable curing frame set forth in claim 1, wherein said slotted track is formed from a slotted tube that covers and protects an end of said stalk from damage.

5. The portable curing frame set forth in claim 1, further comprising legs for supporting said frame member and plants received in said slotted track above the ground.

6. The portable curing frame set forth in claim 5, wherein said legs are pivotally connected to said frame member.

7. The portable curing frame set forth in claim 6, further comprising means for positively locking said pivotal legs in a retracted position along side rails of said frame member and alternatively in an extended position for supporting said frame member above the ground.

8. The portable curing frame set forth in claim 7, further comprising trigger means for releasing said locking means and allowing said legs to be moved from the retracted position to the extended position.

9. The portable curing frame set forth in claim 5, further comprising a means for covering the plants on said curing frame during curing in a field.

10. The portable curing frame set forth in claim 1, wherein said slotted track includes an open end specifically adapted for receiving the stalk of a tobacco plant so as to allow filling and emptying by means of an automated harvester.

11. A portable curing frame for receiving and holding plants, such as tobacco plants during curing, comprising:

a frame member including opposite side rails and opposite end rails;

an elongated slotted tube longitudinally extending between said end rails of said frame member, said tube including an open end specifically adapted for receiving a stalk of a plant in free sliding engagement in the longitudinal direction in said slotted tube, said tube also covering and protecting an end of said stalk from damage; and legs for supporting said frame member and plants received and held in said slotted tube above said ground.

12. The portable curing frame set forth in claim 11, further comprising means for pivotally connecting said legs to said frame member; said legs being pivotally displaceable between a retracted position along the side rails of said frame member and an extended position, substantially perpendicular to said side rails of said frame member so as to support said frame member and plants received in said slotted tube above said ground.

13. The portable curing frame set forth in claim 12, further comprising means for covering said plants on said curing frame during curing in a field.

* * * * *